US007607945B2

(12) United States Patent
Kozono et al.

(10) Patent No.: US 7,607,945 B2
(45) Date of Patent: Oct. 27, 2009

(54) CONNECTOR

(75) Inventors: Seiji Kozono, Shizuoka (JP); Takashi Matsunaga, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/081,750

(22) Filed: Apr. 21, 2008

(65) Prior Publication Data

US 2008/0207030 A1 Aug. 28, 2008

(30) Foreign Application Priority Data

Apr. 11, 2006 (JP) ..... 2006-108959

(51) Int. Cl.
*H01R 13/40* (2006.01)

(52) U.S. Cl. ..... 439/595

(58) Field of Classification Search ..... 439/395, 439/744, 752, 489, 488, 595, 352, 752.5, 439/357–358, 596, 271–273, 372, 350
See application file for complete search history.

(56) References Cited

U.S. PATENT DOCUMENTS

| | | | | |
|---|---|---|---|---|
| 5,928,034 | A * | 7/1999 | Tabata et al. | 439/595 |
| 6,764,334 | B2 * | 7/2004 | Tsuji et al. | 439/595 |
| 7,044,788 | B2 * | 5/2006 | Maeda | 439/595 |
| 7,140,908 | B2 * | 11/2006 | Katsuma | 439/489 |

FOREIGN PATENT DOCUMENTS

| | | |
|---|---|---|
| JP | 2004-220970 | 8/2004 |
| JP | 2007-280889 | 10/2007 |

* cited by examiner

*Primary Examiner*—Edwin A. Leon
(74) *Attorney, Agent, or Firm*—Edwards Angell Palmer & Dodge LLP

(57) ABSTRACT

A connector includes: a connector housing; a housing main body receiving terminal fittings; and a front holder to be attached to the housing main body. When the front holder is attached to the housing main body, and the housing main body receives the terminal fittings, a gap is formed between an outer wall of the housing main body and an inner wall of the front holder.

1 Claim, 5 Drawing Sheets

CONNECTOR

CROSS REFERENCE TO RELATED APPLICATIONS

This application is on the basis of Japanese Patent Application No. 2006-108959, the contents of which are hereby incorporated by reference.

BACKGROUND OF THE INVENTION

1. Field of the Invention

The present invention relates to a connector in which a front holder is attached to a connector housing.

2. Description of the Related Art

Various electronic components are mounted on a vehicle. A wiring harness is used for supplying electric power, control signal or the like to the electronic components. The wiring harness includes a box-shaped or tubular-shaped connector housing and terminal fittings received in the connector housing to be attached to ends of electric wires.

Conventionally, a connector in which a front holder is attached to the connector housing (for example, see Patent Document 1) is used for preventing the terminal fittings from falling out of the connector housing.

As shown in FIGS. 7 and 8, a conventional connector 71 disclosed in the Patent Document 1 is composed of an insulating connector housing 72, an insulating front holder 73, and a female type terminal fittings 75. After the front holder 73 is attached to the connector housing 72, the front holder 73 is movable between a temporary locking position where the female type terminal fittings 75 are allowed to be inserted into terminal receiving chambers of the connector housing 72 and a permanent locking position where the female type terminal fittings 75 are prevented from falling out of the terminal receiving chambers. In the conventional connector 71, after the front holder 73 is positioned at the temporary locking position and the female type terminal fittings 75 are inserted into the terminal receiving chambers, the front holder 73 is positioned at the permanent locking position to prevent the female type terminal fittings 75 from falling out of the terminal receiving chambers.

As shown in FIG. 7, in the conventional connector 71, a bottom wall 77 as an inner wall of a terminal receiving chamber 74 of the connector housing 72 is closely attached to a lower wall 76 as an outer wall of the front holder 73.

[Patent Document 1] Japanese Published Patent Application No. 2004-220970

When the conventional connector 71 is connected to a mating connector, male type terminal fittings 78 as mating terminal fittings are inserted into insides of the female type terminal fittings 75. At this time, as shown in FIG. 8, the male type terminal fittings 78 may be inclined with respect to axes of the female type terminal fittings 75, namely, with respect to the bottom walls 77 of the terminal receiving chambers 74. Thus, when the male type terminal fittings 78 are inserted into the insides of the female type terminal fittings 75 while the male type terminal fittings 78 are inclined, tips of the male type terminal fittings 78 press the bottom walls 77 of the terminal receiving chambers 74.

Because the bottom walls 77 of the terminal receiving chambers 74 are closely attached to the lower wall 76 of the front holder 73, the bottom walls 77 cannot be bent. Therefore, the male type terminal fittings 78 are inserted in a direction of arrow D while slightly deformed by receiving a resistance force from the bottom wall 77. Thus, when the conventional connector 71 is connected to the mating connector, a strong force is needed for pressing the male type terminal fittings 78. Therefore operability for connecting the conventional connector 71 to the mating connector is reduced, and the tips of the male type terminal fittings 78 may be damaged or plastically deformed.

Further, as shown in FIG. 8, when a projection 80 is formed on a contact part 79 where the male type terminal fitting 78 abuts on the female type terminal fitting 75, the tip of the male type terminal fitting 78 is caught by the projection 80. Therefore, a stronger force is needed for inserting the male type terminal fittings 78 into the insides of the female type terminal fittings 75. Thus, the operability for connecting the conventional connector 71 to the mating connector is further reduced.

Accordingly, an object of the present invention is to provide a connector which can improve the operability for connecting the connector to the mating connector.

SUMMARY OF THE INVENTION

In order to attain the object, according to the present invention, there is provided a connector including:

a connector housing;

a housing main body receiving terminal fittings; and a front holder to be attached to the housing main body, wherein when the front holder is attached to the housing main body, and the housing main body receives the terminal fittings, a gap is formed between an outer wall of the housing main body and an inner wall of the front holder which is overlapped with the outer wall of the housing main body.

According to the present invention, because a gap is formed between the outer wall of the housing main body and the inner wall of the front holder, when the terminal fittings abut on mating terminal fittings, even if the mating terminal fittings press the terminal fittings, the outer wall of the housing main body is bent toward the gap, namely, toward the inner wall of the front holder.

These and other objects, features, and advantages of the present invention will become more apparent upon reading of the following detailed description along with the accompanied drawings.

DETAILED DESCRIPTION OF THE PREFERRED EMBODIMENTS

Hereafter, a connector 1 according to a first embodiment of the present invention will be explained with reference to FIGS. 1 to 5.

Figure 1:
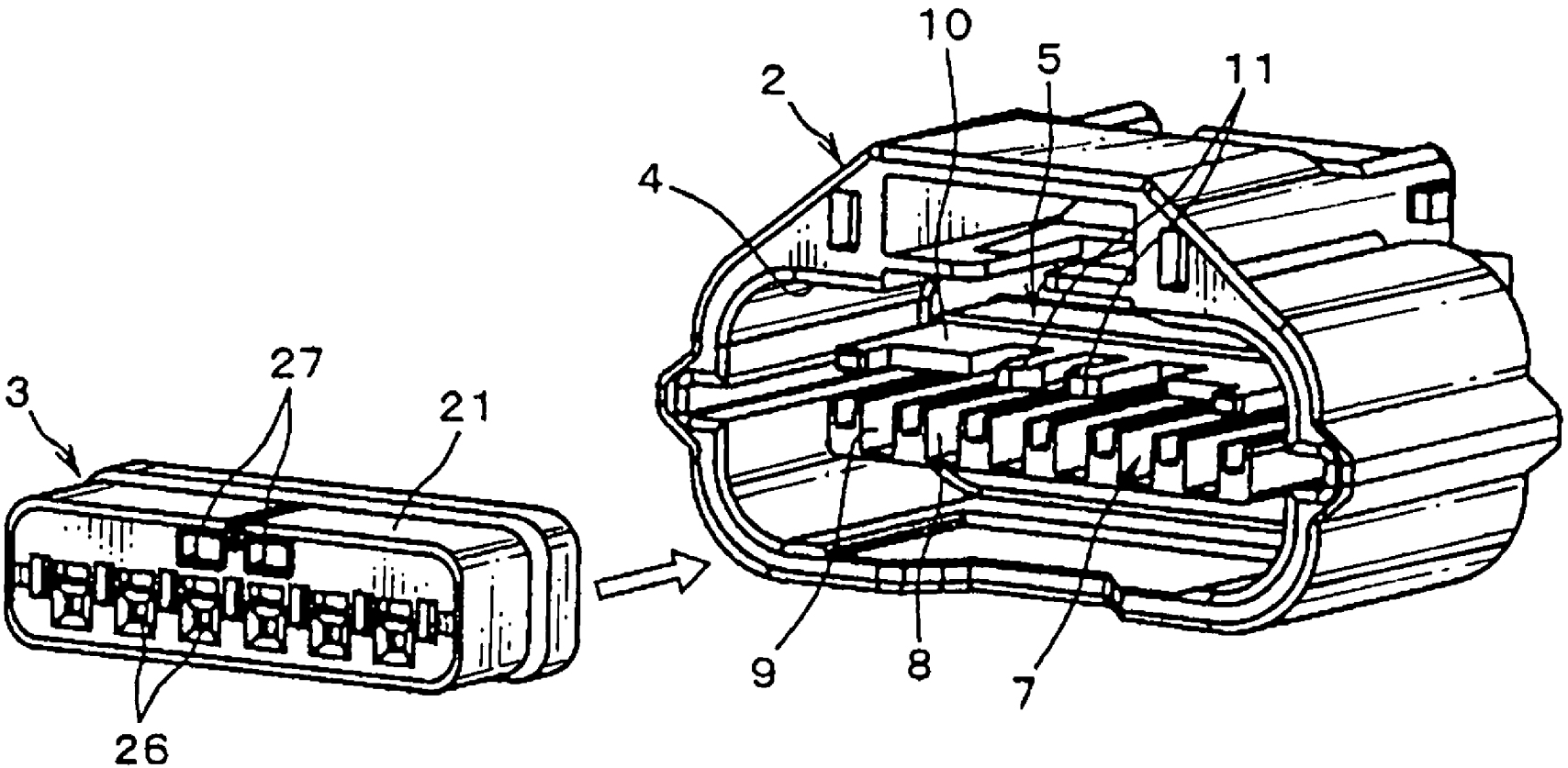
FIG. 1 is a perspective view showing a connector housing and a front holder as components of a connector according to a first embodiment of the present invention.

The connector 1 includes: a connector housing 2 shown in FIG. 1; a front holder 3 to be inserted into an inside of the connector housing 2 in an arrow direction of FIG. 1 and attached to a housing main body 5; and female type terminal fittings 6 having electric wires (corresponding to terminal fittings in claims, and hereafter referred to as female terminals 6).

The connector housing 2 is made of insulating synthetic resin. As shown in FIGS. 1 and 2, the connector housing 2 is composed of a substantially rectangular tubular outer hood 4 and the tubular inner housing main body 5. A locking arm 12 for locking on a mating female type connector (not shown) is formed on the hood 4. The housing main body 5 is projected from a base wall which is perpendicular to an engaging direction of the connector 1 toward the mating female connector in an inner space of the hood 4.

Terminal receiving chambers 7 are formed on the housing main body 5. The terminal receiving chambers 7 are extended in the engaging direction of the connector 1. Terminal insertion holes 14 communicating with the terminal receiving chambers 7 are formed on a base wall 13. The terminal receiving chambers 7 are straight spaces and both ends of each terminal receiving chamber 7 are open on the housing main body 5, namely, on an outer surface of the connector housing 2. The plurality of terminal receiving chambers 7 is parallel to each other. Partition walls 8 partitions the terminal receiving chambers 7, and each terminal receiving chamber 7 has a substantially rectangular front opening 9. Resilient terminal locking pieces 15 for locking the female terminals 6 are formed on insides of the terminal receiving chambers 7.

Figure 2A:
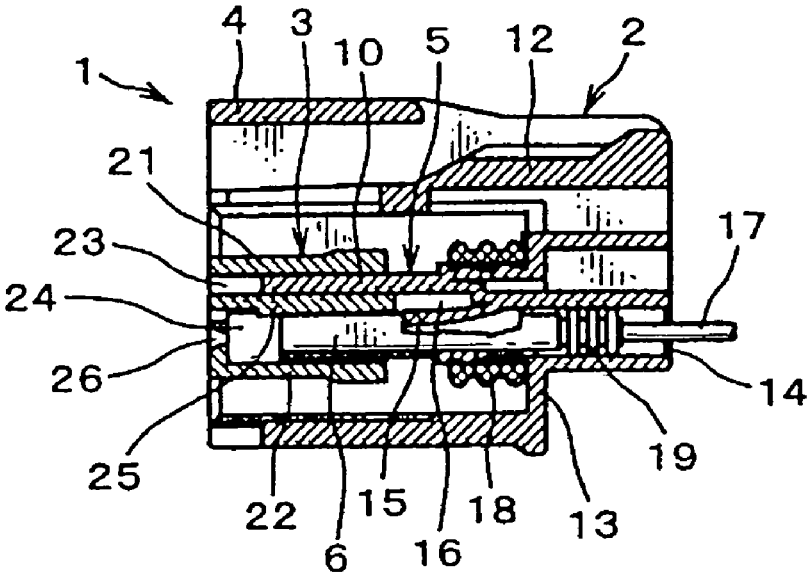
FIG. 2A is a vertical sectional view showing the front holder of FIG. 1 attached at a temporary locking position.
Figure 2B:
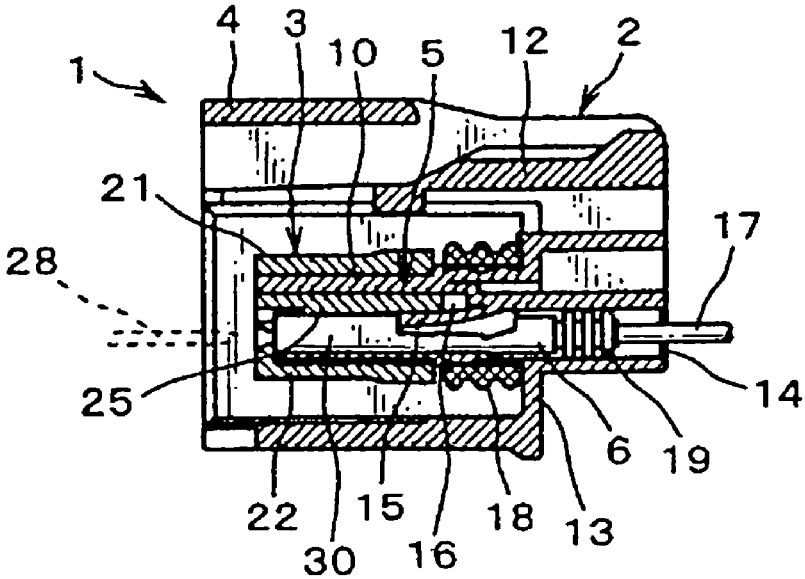
FIG. 2B is a vertical sectional view showing the front holder of FIG. 1 attached at a permanent locking position.

The front holder 3 is made of insulating synthetic resin, and formed in a substantially rectangular tubular shape. The front holder 3 is inserted into an inside of the hood 4 via a male type connector side of the connector housing 2 and attached to an outer periphery of the housing main body 5. As shown in FIGS. 2A and 2B, the front holder 3 includes an upper wall 21, a lower wall 22, upper and lower horizontal spaces 23, 24 and a board wall 25 partitioning the upper and lower spaces 23, 24. The board wall 25 is projected from a rear end of the front holder 3 and allowed to be inserted into bending spaces 16 of the terminal locking pieces 15. An upper wall 10 of the housing main body 5 is inserted into the upper space 23, and the partition walls 8 parallel to each other (see FIG. 1) are inserted into the lower space 24.

Male terminal insertion holes 26 are formed on the front side of the front holder 3 corresponding to positions of the terminal receiving chambers 7 of the housing main body 5. A tapered wall is formed on each male terminal insertion hole 26 for guiding a tip of a male type terminal fitting (hereafter referred to as male terminal) as a mating terminal fitting when inserting the male terminal.

A female terminal 6 is formed by, for example, punching and folding a conductive metallic plate. An electric wire 17 is attached to an electric wire connecting part of the female terminal 6 and electrically connected to the electric wire 17. Further, a male terminal 28 is inserted into a tubular electrically connecting part of the female terminal 6 and electrically connected to the female terminal 6.

The connector 1 having above described structure is assembled in a way described below. Firstly, while the female terminal 6 is not inserted into the housing main body 5, the front holder 3 is inserted into the connector housing 2 from a front side of the connector housing 2. A locking part 27 of the front holder 3 is temporarily locked on a locking arm 11 formed on the upper wall 10 of the housing main body 5 as shown in FIG. 1. At this time, the board wall 25 of the front holder 3 is spaced from and not inserted into the bending spaces 16. This position of the front holder 3 is referred to as a temporary locking position. In this temporary locking position, the front holder 3 allows the terminal locking pieces 15 to be resiliently deformed, and allows the female terminals 6 to be inserted into the terminal receiving chambers 7.

Under this condition, the female terminals 6 having the electric wires 17 are inserted into the terminal receiving chambers 7 through the terminal insertion holes 14 of the housing main body 5. Then, terminal locking pieces 15 are temporarily resiliently deformed toward the bending spaces 16, and the female terminal 6 are moved forward. When the female terminal 6 are inserted a predetermined distance, the terminal locking pieces 15 are restored, and the female terminal 6 are locked (FIG. 2A).

Then, as shown in FIG. 2B, when the front holder 3 is further inserted into the connector housing 2 in a direction opposite to an insertion direction of the female terminals 6, the board wall 25 in the middle of the front holder 3 is inserted into the bending spaces 16 of the terminal locking pieces 15 to prevent the terminal locking pieces 15 from being resiliently deformed. This position of the front holder 3 is referred to as a permanently locking position. In this permanently locking position, the front holder 3 prevents the terminal locking pieces 15 from being resiliently deformed, prevents the female terminals 6 from being further inserted into the terminal receiving chambers 7, and prevents the female terminal 6 from falling out of the terminal receiving chambers 7. Thus, the front holder 3 is attached to the terminal receiving chambers 7 of the housing main body 5, and the female terminal 6 are fixed to insides of partitioned female terminal receiving parts 30.

When the connector 1 is connected to the male type connector, the male terminals 28 are inserted into the electric contact parts of the female terminals 6, and the male terminals 28 and the female terminals 6 are contacted to each other. Thus, the male terminals 28 and the female terminals 6 are electrically contacted to each other. The male terminals 28 are formed by, for example, punching and folding a conductive metallic plate.

For preventing water from entering the female terminal receiving parts 30, a waterproof packing 18 is attached to the outer periphery of the base side of the housing main body 5, and a waterproof plug is attached to outer periphery of the electric wire 17 in the terminal insertion hole 14.

Figure 3:
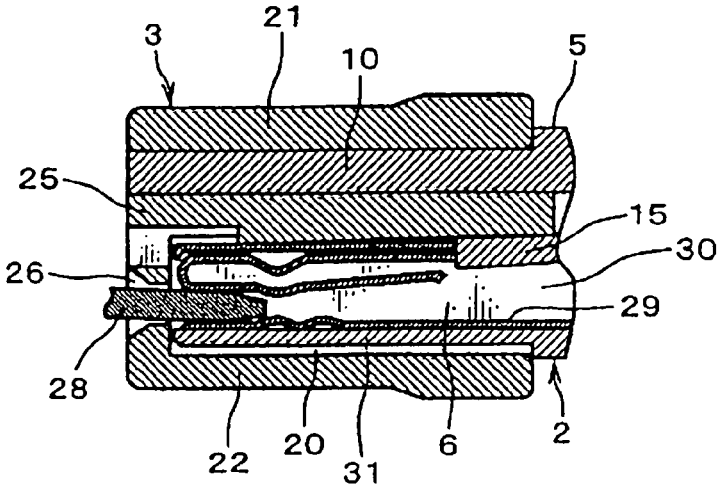
FIG. 3 is a partially enlarged sectional view showing a male terminal fitting inserted into a female terminal fitting of the connector shown in FIG. 2.

According to the present invention, as shown in FIG. 3, a gap 20 in a vertical direction is formed between a bottom wall 31 as an outer wall of the female terminal receiving part 30 of the housing main body 5 and a lower wall 22 as an inner wall of the front holder 3 when the connector 1 composed of the connector housing 2, the front holder 3, and the female terminals 6 is assembled. Namely, a size of the lower space 24 formed between the board wall 25 and the lower wall 22 is so designed that the gap 20 is formed between the lower wall 22 and the bottom wall 31 in the vertical direction when the front holder 3 is attached to the housing main body 5.

Figure 4:
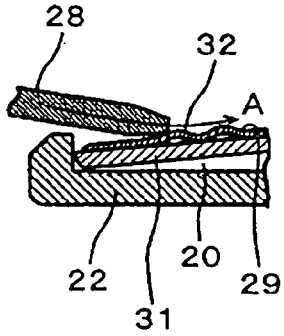
FIG. 4 is an explanatory view showing an example of a state when the male terminal is inserted into the female terminal shown in FIG. 3.

For example, as shown in FIG. 4, when the male terminal 28 is inserted obliquely downward into the horizontal electric contact part of the female terminal 6, a tip of the male terminal 28 presses downward an inner wall of the electric contact part of the female terminal 6. When the female terminal 6 is pressed, the bottom wall 31 of the female terminal receiving part 30 of the housing main body 5 is bent downward toward the gap 20, namely, toward the lower wall 22 of the front holder 3. Therefore, pressing force of the male terminal 28 is absorbed. Therefore, resistance force when the male terminal 28 is inserted into the electric contact part of the female terminal 6, namely, when the male terminal 28 contacts the female terminal 6 is reduced. Therefore, even if a projection 32 is formed on a contact part 29 of the inner wall of the electric contact part of the female terminal 6 where the male terminal 28 contacts the female terminal 6, as shown by an arrow A in FIG. 4, the male terminal 28 is smoothly inserted.

Figure 5:
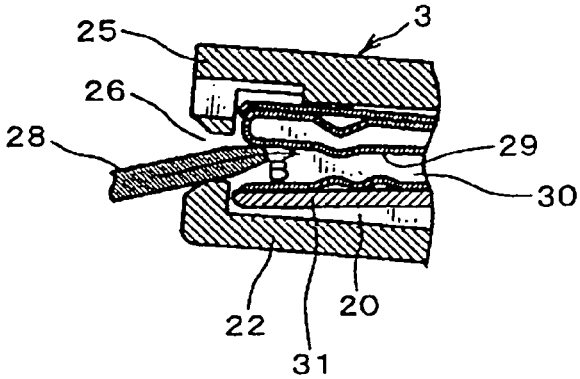
FIG. 5 is an explanatory view showing another example of a state when the male terminal is inserted into the female terminal shown in FIG. 3.

For example, as shown in FIG. 5, when the male terminal 28 is inserted obliquely upward into the horizontal electric contact part of the female terminal 6, the tip of the male terminal 28 presses upward the inner wall of the electric contact part of the female terminal 6. At this time, the bottom wall 31 of the female terminal receiving parts 30 of the housing main body 5 is bent downward toward the gap 20, namely, toward the lower wall 22 of the front holder 3. Consequently, a whole female terminal receiving part 30 is inclined to reduce the pressing force of the male terminal 28. Therefore, the resisting force when the male terminal 28 is inserted into the electric contact part of the female terminal 6, namely, when the male terminal 28 contacts the female terminal 6 is reduced, and as shown by an arrow B in FIG. 5, the male terminal 28 is smoothly inserted.

Thus, even when the male terminal 28 is inclined with regard to the female terminal 6, the connector 1 is connected to the female connector as the mating connector with a little pressing force. Therefore, connecting operability to the female connector is increased. Further, damages or deformations of the male terminal 28 and the female terminal 6 are prevented.

Figure 6A:
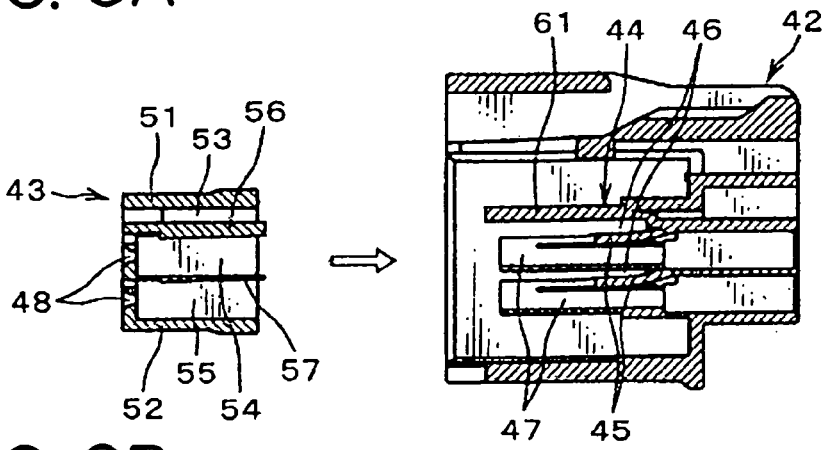
FIG. 6A is a vertical sectional view showing a connector housing and a front holder as components of a connector according to a second embodiment of the present invention.
Figure 6B:
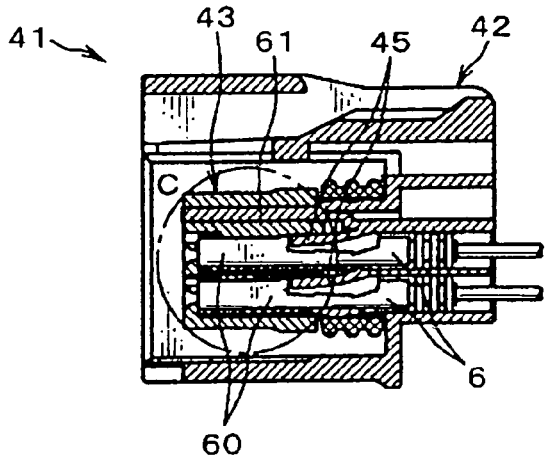
FIG. 6B is a vertical sectional view showing a state that the front holder is attached to the connector housing shown in FIG. 6A.
Figure 6C:
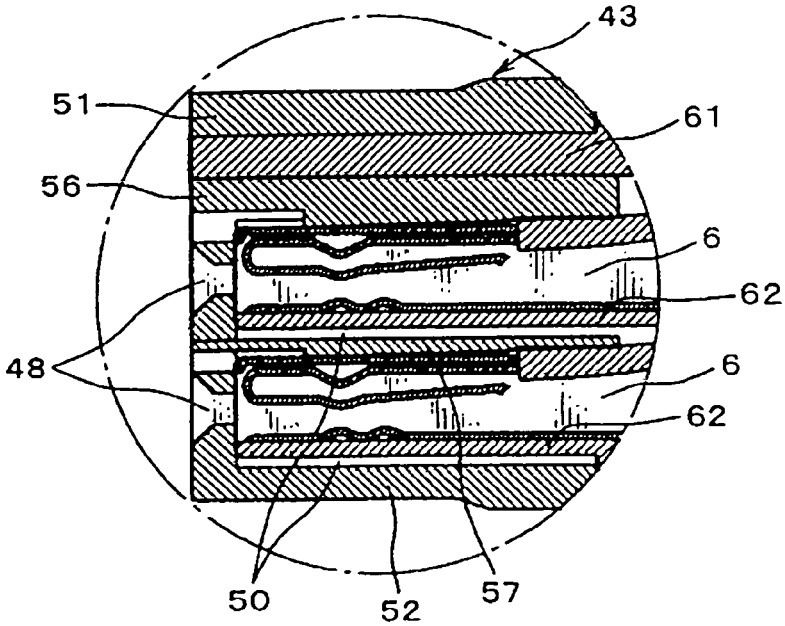
FIG. 6C is an enlarged view showing an area indicated by "C" in FIG. 6B.
Figure 7:
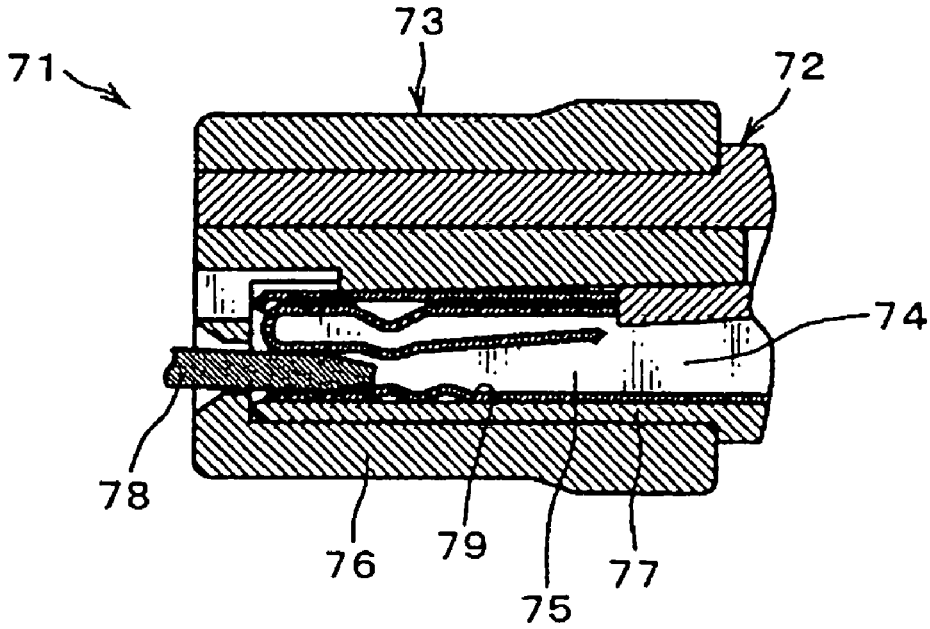
FIG. 7 PRIOR ART
FIG. 7 is a partially sectional view showing a state that a male terminal fitting is inserted into a female terminal fitting received in a conventional connector.
Figure 8:
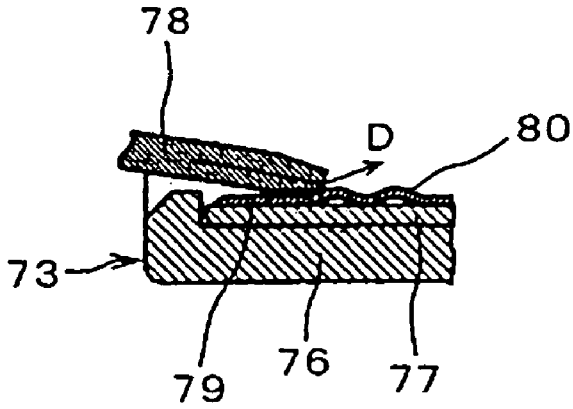
FIG. 8 PRIOR ART
FIG. 8 is an explanatory view showing another state that the male terminal fitting is inserted into the female terminal fitting received in the conventional connector shown in FIG. 7.

FIGS. 6A to 6C show a second embodiment of the present invention. In the second embodiment, two-tiered terminal receiving chambers 47 are formed in a connector 41.

As shown in FIG. 6A, two-tiered terminal receiving chambers 47 are formed on a housing main body 44 of a connector housing 42. Two-tiered male terminal insertion holes 48 are formed corresponding to positions of the terminal receiving chambers 47 of the housing main body 44 at a front side of a front holder 43. The front holder 43 includes an upper wall 51, a lower wall 52, upper and lower horizontal spaces 53, 54, 55 a board wall 56 partitioning the spaces 53, 54, and a middle wall 57 partitioning the spaces 54, 55. The board wall 56 is projected from a rear end of the front holder 43 and allowed to be inserted into bending spaces 46 of the terminal locking pieces 45. An upper wall 61 of the housing main body 44 is inserted into the space 53, and partition walls for partitioning the terminal receiving chambers 47 of the housing main body 44 are inserted into the lower two-tiered spaces 54, 55.

An assembling way of the connector 41 composed of the connector housing 42, the front holder 43, and the female terminal 6 of the second embodiment is substantially the same as that of the first embodiment. Therefore, an explanation of the assembling method is omitted.

When the connector 41 is assembled as shown in FIG. 6B, gaps 50, 50 are formed between one of bottom walls 62 as outer walls of the two-tiered female terminal receiving parts 60 of the housing main body 44 and the middle wall 57, and between the other bottom wall 62 and the lower wall 52 as shown in FIG. 6C. Owing to the gaps 50, 50, as explained above with reference to FIGS. 4 and 5, the resistance when the male terminal is inserted is reduced, and the male terminal is allowed to be smoothly inserted. Thus, the second embodiment produces the same effects as the first embodiment.

Similarly, the present invention is applicable to a case where a connector includes more than two tiers of female terminal receiving parts. Further, in the first and second embodiments, the gap 20 is formed between the bottom wall 31 as an outer wall and the bottom wall 22 as an inner wall, and the gaps 50, 50 are formed between the bottom wall 62 and the middle wall 57, and between the other bottom wall 62 and the lower wall 52. However, according to the present invention, a gap may be formed between an outer wall other than the bottom walls 31, 62 of the housing main body 5, 44 and an inner wall other than the middle wall 57 or the lower wall 52 of the front holder 3, 43.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein. For example, a locking manner between a connector housing and a front holder or female terminals is not limited to the first and second embodiments. Also, the numbers and an arrangement of the female terminals are not limited to the first and second embodiments.

What is claimed is:

1. A connector comprising:

a connector housing;

a housing main body receiving terminal fittings having a bottom outer wall; and a front holder, having a terminal insertion hole at one end and a lower inner wall extending from the terminal insertion hole, to be attached to abut the terminal fittings received in the housing main body, whereby the bottom outer wall overlaps on the inside of the lower inner wall forming a gap therebetween extending from the terminal insertion hole alone the length of the lower inner wall, wherein when the front holder is attached to the housing main body, and the housing main body receives the terminal fittings, and when a male terminal is inserted into the terminal insertion hole, the bottom outer wall can be bent downward and a pressing force of the male terminal can be absorbed.

* * * * *